US008822862B2

(12) United States Patent
Cyuzawa

(10) Patent No.: US 8,822,862 B2
(45) Date of Patent: Sep. 2, 2014

(54) DC BREAKER

(75) Inventor: Takaaki Cyuzawa, Hirakata (JP)

(73) Assignee: Panasonic Corporation, Kadoma-shi (JP)

( * ) Notice: Subject to any disclaimer, the term of this patent is extended or adjusted under 35 U.S.C. 154(b) by 434 days.

(21) Appl. No.: 13/381,398

(22) PCT Filed: Jun. 29, 2010

(86) PCT No.: PCT/JP2010/061011
§ 371 (c)(1),
(2), (4) Date: Feb. 1, 2012

(87) PCT Pub. No.: WO2011/001956
PCT Pub. Date: Jan. 6, 2011

(65) Prior Publication Data

US 2012/0132508 A1 May 31, 2012

(30) Foreign Application Priority Data

Jun. 30, 2009 (JP) ..... 2009-156112

(51) Int. Cl.
*H01H 1/66* (2006.01)
*H01H 73/18* (2006.01)
*H01H 71/02* (2006.01)
*H01H 83/20* (2006.01)

(52) U.S. Cl.
CPC ..... *H01H 71/0235* (2013.01); *H01H 1/66* (2013.01); *H01H 83/20* (2013.01)
USPC ..... 200/405; 335/16; 335/201

(58) Field of Classification Search
CPC ..... H01H 9/34; H01H 9/46; H01H 9/46; H01H 73/18; H01H 73/38; H01H 71/00; H01H 1/66
USPC ..... 200/405, 409, 424, 440, 441, 442, 447, 200/450, 453, 457–460, 16 A–16 D; 335/6, 335/16, 21, 55, 167–174
See application file for complete search history.

(56) References Cited

U.S. PATENT DOCUMENTS 4,470,028 A 9/1984 Vayre et al.
4,631,507 A * 12/1986 Guery et al. ..... 335/27

(Continued)

FOREIGN PATENT DOCUMENTS

CN 101226860 A 7/2008
EP 0715326 A2 6/1996

(Continued)

OTHER PUBLICATIONS

International Search Report dated Aug. 10, 2010, issued for PCT/JP2010/061011.

(Continued)

*Primary Examiner* — Amy Cohen Johnson
*Assistant Examiner* — Marina Fishman
(74) *Attorney, Agent, or Firm* — Edwards Wildman Palmer LLP

(57) ABSTRACT

It comprises fixed terminal 42 provided with fixed contact 42*a*; movable armature 44 provided with movable contact 45; shaft 44 inserted in the movable armature; sealing container 40 holding the fixed terminal and housing the movable armature and the shaft therein in hermetically-sealed state; contact pressure spring 410 giving contact pressure between the movable contact and the fixed contact; return spring 411 urging the shaft to move away from the fixed contact; operation handle 1; shaft pressing piece 56 pressing, in accordance with the operation of the operation handle, the other end of main body of the shaft to move the shaft closer to the fixed contact; and electromagnetic tripping block 6 which makes the movable/fixed contacts open by taking the pressing means away from the other end of the main body of the shaft in case that anomalous current flows through the movable/fixed contacts when they are contacted.

4 Claims, 3 Drawing Sheets

(56) References Cited

U.S. PATENT DOCUMENTS

| | | | | |
|---|---|---|---|---|
| 4,855,698 | A * | 8/1989 | Cohen et al. | 335/14 |
| 5,680,084 | A | 10/1997 | Kishi et al. | |
| 6,809,282 | B2 * | 10/2004 | Fasano | 218/40 |
| 7,859,373 | B2 * | 12/2010 | Yamamoto et al. | 335/126 |
| 2004/0051605 | A1 | 3/2004 | Fasano | |

FOREIGN PATENT DOCUMENTS

| | | | |
|---|---|---|---|
| GB | 2295275 | A | 5/1996 |
| JP | 56-130050 | A | 10/1981 |
| JP | 58-108627 | A | 6/1983 |
| JP | 10-188711 | A | 7/1998 |
| JP | 11-297181 | A | 10/1999 |
| JP | 2001-023500 | A | 1/2001 |
| JP | 2004-022525 | A | 1/2004 |
| JP | 2006-032077 | A | 2/2006 |

OTHER PUBLICATIONS

Supplementary European Search Report dated Jan. 29, 2014, issued for the corresponding European patent application No. 10794125.4.
Office Action dated Jan. 6, 2014, issued for the corresponding Chinese patent application No. 201080029654.7.

* cited by examiner

DC BREAKER

TECHNICAL FIELD

The present invention relates generally to a DC (direct-current) breaker.

BACKGROUND ART

In a conventional DC breaker for breaking DC (direct-current) electric path, it has been mainly adopted the DC breaking method based on current-limiting type or vibration-type. As for its opening/closing mechanism, it has been used the mechanical contact or the contactless switch of semiconductor (e.g., Japan patent application laid-open No. 2006-32077).

According to the DC breaker which uses the semiconductor contactless switch for the opening/closing mechanism, it can break the electric path without occurring the arc. However, for such the DC breaker, a commutation means such as a snubber circuit should be provided for the purpose of suppressing the generation of the surge voltage resulting from the cutting phenomenon. Even more particularly, the mechanical contact was often necessary for the purpose of secure energization and disconnecting (e.g., Japan patent application laid-open no. 2004-22525).

In recent years, DC breaker has been used in the DC electric path of the electric vehicle or in the DC electric path of the indoor DC distribution system. It has been demanded a DC breaker with: (1) high breaking capacity to the direct current; (2) compact size; (3) enhanced safety; (4) small sound at the time of acting the contacts; and (5) high contact reliability.

DISCLOSURE OF THE INVENTION

It is an object of the present invention to provide the DC breaker which can realize: high breaking capacity to the direct current; compact size; enhanced safety; small sound; and high contact reliability.

The DC breaker of the present invention comprises: a fixed terminal provided with a fixed contact; a movable armature provided with a movable contact which contacts to or separates from said fixed contact, said movable armature being provided with a shaft insertion hole passing therethrough in the approaching/separating direction of said movable contact with respect to said fixed contact; a shaft having a main body and a deterring part, said main body being inserted in said shaft insertion hole of said movable armature, said deterring part being formed in un-insertable shape in said shaft insertion hole and being coupled with one end of said main body to restrict the movement of said movable armature into the direction in which said movable contact approaches to said fixed contact; a sealing container housing said movable armature and said shaft therein in hermetically-sealed state and also holding said fixed terminal so that said fixed contact being exposed thereinside; a contact pressure spring consisting of a coil spring arranged within said sealing container, said main body of said shaft being inserted in said contact pressure spring, said contact pressure spring being configured to resiliently contact at one end thereof to said movable armature to urge said movable armature to approach toward said fixed contact and to give contact pressure between said movable contact and said fixed contact; a return spring consisting of a coil spring arranged within said sealing container, said return spring being configured to resiliently contact at one end thereof to said deterring part of said shaft to urge said shaft to move away from said fixed contact; an operation handle; a pressing means configured to press, in accordance with the operation of said operation handle, the other end of said main body of said shaft to move said deterring part of said shaft closer to said fixed contact; and a tripping means configured to make said movable contact and said fixed contact open by taking said pressing means away from said the other end of said main body of said shaft in case that an anomalous current flows through said movable contact and said fixed contact when they are contacted.

According to the present invention, the contact section is disposed inside the sealing container of airtight structure. Thus, the present invention can provide the DC breaker which realizes the high breaking capacity to the direct current, the compact size, the enhanced safety, the small sound, and the high contact reliability. Besides, the contact section can be manually opened/closed by manually operating the operation handle. In addition, when the DC breaker is used as the protecting means of the DC device in substitution for the fuse that is not reusable, it can improve the convenience of the user.

In one embodiment, mixed gas including hydrogen is enclosed in said sealing container.

According to this embodiment, the arc generated at the opening point, which is the time the movable contact moves away from the fixed contact, is cooled by the mixed gas including hydrogen enclosed in the sealing container of airtight structure to generate high arc voltage. Thereby, this embodiment can rapidly limit the conduction current and can break the electric path certainly.

In one embodiment, said DC breaker further comprises a leakage detection means configured to detect electrical leakage of DC electric path in which a contact section consisting of said movable contact and said fixed contact being inserted, and said tripping means is configured to make said movable contact and said fixed contact open by taking said pressing means away from said the other end of said main body of said shaft when the electrical leakage is detected.

According to this embodiment, it can secure the safeness when the electrical leakage occurs.

BRIEF DESCRIPTION OF THE DRAWINGS

Preferred embodiments of the invention will now be described in further details. Other features and advantages of the present invention will become better understood with regard to the following detailed description and accompanying drawings where:

FIG. 3 shows a configuration of DC distribution system which the DC breaker is used in.

BEST MODE FOR CARRYING OUT THE INVENTION

Embodiment

Figure 2:
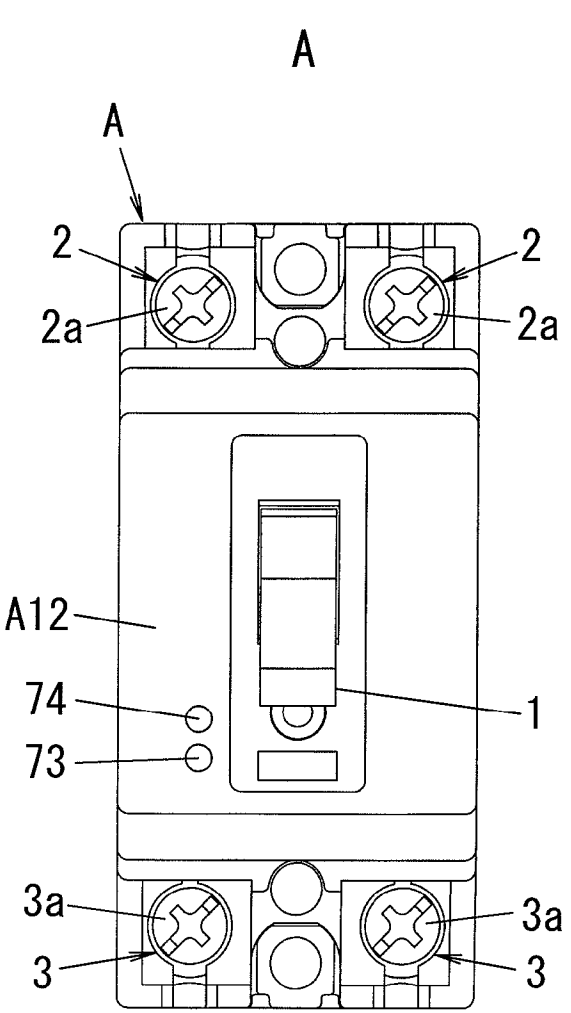
FIG. 2 shows an outer appearance of the DC breaker.
Figure 2:
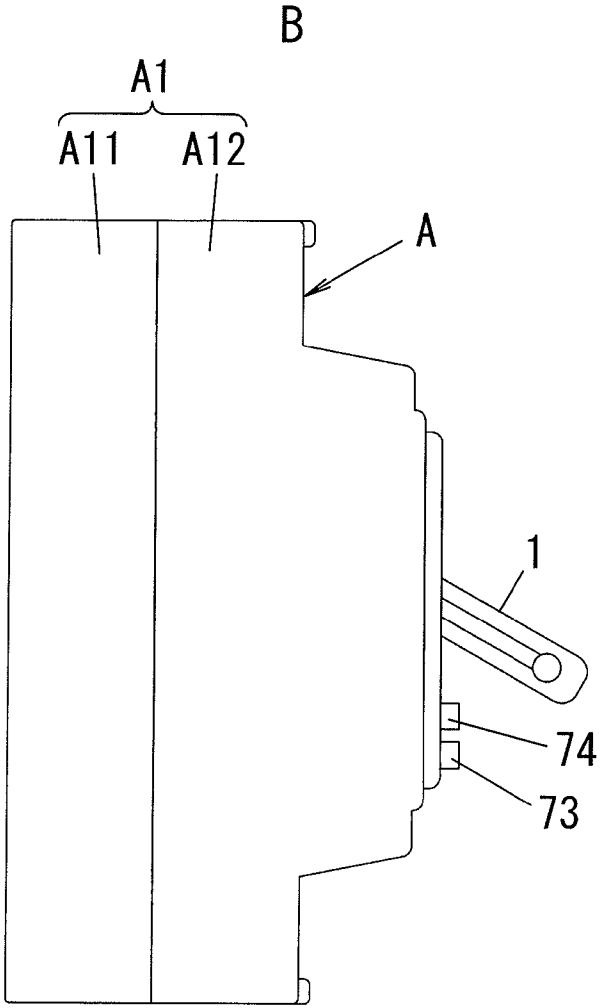

A DC breaker A of the present embodiment is formed in a bipolar type. As shown in FIG. 2A and FIG. 2B, a container body A1 of the DC breaker A is constructed by a body A11 and a cover A12 both of which are composed of synthetic resin molded article. The longitudinal one end of the container body A1 is provided with a pair of terminal portions (referred to as power supply side terminal portions) 2, 2 configured to be connected to DC power supply. The power supply side terminal portions 2, 2 are disposed side by side in the shorter direction of the container body A1. The longitudinal the other end of the container body A1 is provided with a pair of terminal portions (referred to as load side terminal portions) 3, 3 configured to be connected to a load. The load side terminal portions 3, 3 are disposed side by side in the shorter direction of the container body A1. In the container body A1, contact sections are installed in the DC electric paths between the power supply side terminal portions 2, 2 and the load side terminal portions 3, 3. The longitudinal central part of the front side of the container body A1 is provided with an operation handle 1 for switching the contact sections.

Figure 1:
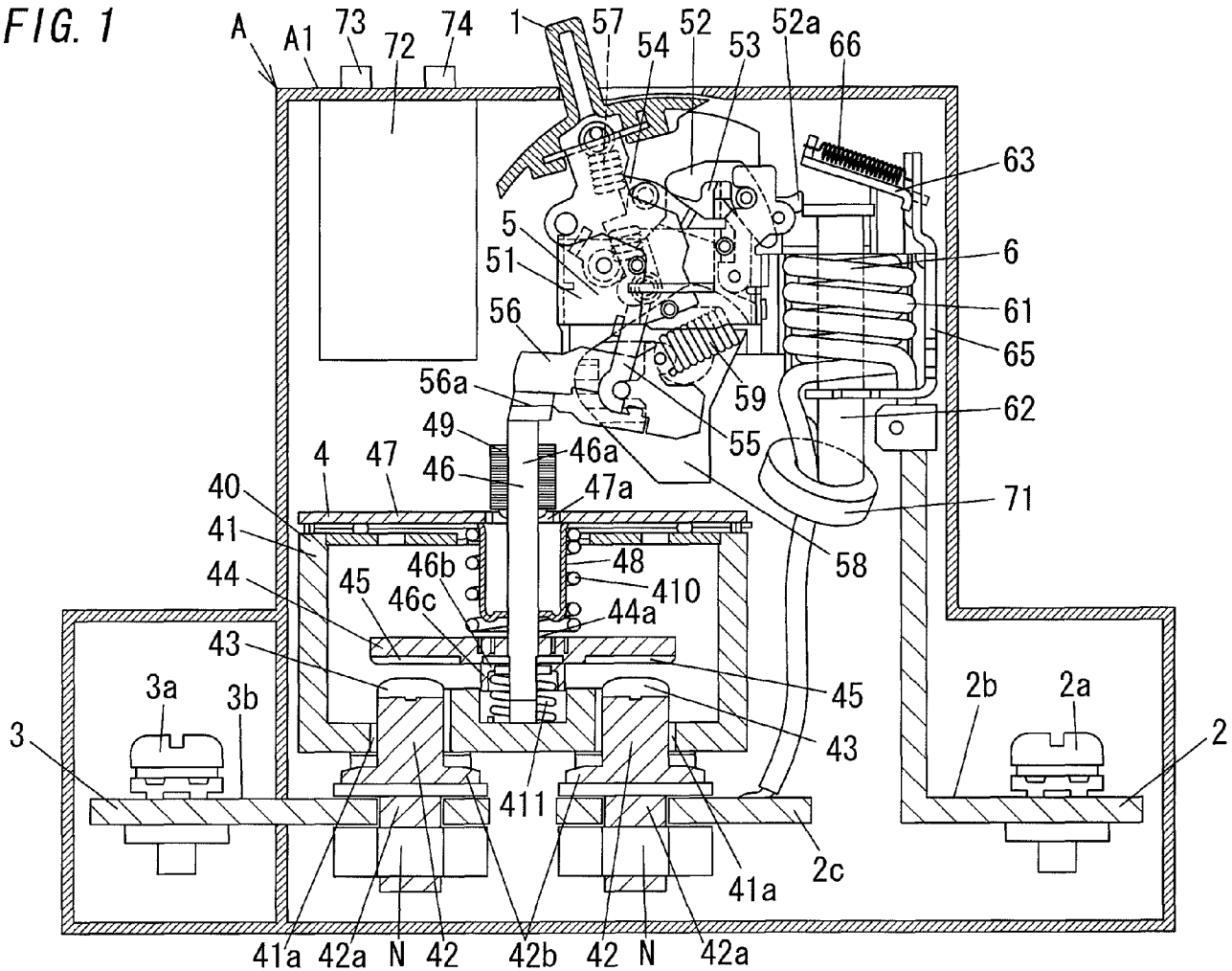
FIG. 1 shows a side sectional view of the DC breaker of the present invention when the contacts are closed.

As shown in FIG. 1, contact blocks 4, a linking block 5, and electromagnetic tripping blocks 6 are housed in the container body A1. The contact blocks 4 include the contacts installed in the electric paths between the power supply side terminal portions 2, 2 and the load side terminal portions 3, 3. The linking block 5 is composed of a plurality of link pieces, and configured to transmit the turning operation of the operation handle 1 to the contact block 4. The electromagnetic tripping blocks 6 are configured to forcibly separate off the contacts at the time of occurring an excess current and a short-circuit current. In the following explanation, directions of "top (up)", "bottom (down)", "right", and "left" are based on the directions in FIG. 1. Note that, FIG. 1 shows only one contact block 4 and one electromagnetic tripping block 6 which correspond to one-pole. However, the DC breaker A of the present embodiment is the bipolar type. Thus, two of contact blocks 4 and two of electromagnetic tripping blocks 6, each of which corresponds to each of one-pole, are provided side by side in the front-back direction of FIG. 1.

The power supply side terminal portion 2 includes a terminal screw 2*a* and a terminal board 2*b*. The terminal board 2*b* is formed in substantially L-shaped in which it extends upward after lying along the basal plane of the container body A1. The terminal board 2*b* is connected, through the electromagnetic tripping block 6, with a terminal board 2*c*. The terminal board 2*c* is arranged separately from the terminal board 2*b*, and disposed along the basal plane of the container body A1. Also, the load side terminal portion 3 includes a terminal screw 3*a* and a terminal board 3*b*. The terminal board 3*b* extends along the basal plane of the container body A1.

The contact block 4 includes a sealing member 41. The sealing member 41 is made of heat-resistant materials such as ceramic. The sealing member 41 is formed in the rectangular solid shape whose top face is opened. Two of through holes 41*a* are provided at the basal plane of the sealing member 41 side by side in the right-left direction. A fixed terminal 42 is inserted in each of the through-hole 41*a*. The fixed terminal 42 is made, for example, of metallic material including copper. The fixed terminal 42 has a cylindrical-shaped body part 42*a* and a flange part 42*b*. The flange part 42*b* projects from the substantially central part of the body part 42*a* toward the radial direction thereof, and is located on the top surface of the terminal board 2*c* or 3*b*. A fixed contact 43 is adhered to the upper end of the body part 42*a*. Note that, the fixed contact 43 can be formed integrally with the fixed terminal 42. The fixed terminal 42 is hermetically bonded to the sealing member 41 in the vicinity of the flange part 42*b* by means of, for example, brazing. Furthermore, groove is threaded in the lower part of the fixed terminal 42. The fixed terminal 42 is attached to the terminal board 2*c* or 3*b* by screwing a nut N to fit with the groove from the lower end thereof.

A movable armature 44 is made, for example, of metallic material including copper, and formed in a flat-shape. The movable armature 44 is placed within the sealing member 41 so that the thickness direction of the movable armature 44 faces to the top-bottom direction. A pair of movable contacts 45 are adhered on right and left ends of the under surface of the movable armature 44. Pair of the movable contacts 45 face with the fixed contacts 43.

A shaft insertion hole 44*a* is provided in the right-left direction center of the movable armature 44 so as to penetrate the movable armature 44. A shaft 46 made of insulation material is inserted in the shaft insertion hole 44*a*. The shaft 46 has a main body 46*a* and a deterring part 46*b*. The main body 46*a* is formed in a cylindrical shape and is inserted in the shaft insertion hole 44*a* so that the axial direction thereof faces to the top-bottom direction. The deterring part 46*b* is formed in a disk shape which the diameter of is larger than the inner diameter of the shaft insertion hole 44*a*. The deterring part 46*b* is connected with the lower end of the main body 46*a* and projects outward in the radial direction with respect to the main body 46*a*.

Besides, a sealing cover 47 made of heat-resistant material such as ceramic is hermetically bonded to the opening of the top face of the sealing member 41. The sealing container 40 is composed of the sealing member 41 and the sealing cover 47. An insertion hole 47*a* for being inserted by the main body 46*a* of the shaft 46 is provided at the substantially center of the sealing cover 47 so as to penetrate in the top-bottom direction. A cap 48 made of metal and served as a partition is joined to the under surface of the sealing cover 47, and the main body 46*a* of the shaft 46 is inserted through the cap 48 in the top-bottom direction. Besides, a bellows-shaped bellows 49 made of such as nickel is joined to the top face of the sealing cover 47. The main body 46*a* of the shaft 46 is inserted in the bellows 49 in the top-bottom direction.

In addition, the main body 46*a* of the shaft 46 is inserted in a contact pressure spring 410 consisting of a helical compression spring. The contact pressure spring 410 is disposed in a compression state, in a manner the lower end thereof resiliently contacts with the top surface of the movable armature 44 and the upper end thereof resiliently contacts with the under surface of the sealing cover 47. In the state where the shaft 46 is sufficiently displaced downward, the movable contacts 45 on the right and left ends of the movable armature 44 are pushed to the fixed contacts 43 by the elastic force of the contact pressure spring 410, respectively.

Also, the insertion hole 47*a* of the sealing cover 47 is closed up by the cap 48 joined to the under surface of the sealing cover 47 and the bellows 49 joined to the top surface of the sealing cover 47. The sealing container 40 is sealed up by providing the fixed terminals 42, the sealing cover 47, the cap 48 and the bellows 49 to the sealing member 41. Hydrogen-based mixed gas is enclosed in the sealing container 40 at about, for example, 2 standard atmospheres.

In addition, a return spring 411 composed of a helical compression spring is interposed between the under surface of the deterring part 46*b* of the shaft 46 and the basal plane of the sealing container 40. That is, the movable armature 44 is biased upward by the elastic force of the return spring 411. Additionally, circular frame 46*c* is protrudingly provided downward at the circumference of the deterring part 46*b*. Because the upper end of the return spring 411 is fitted in the concavity formed inside the circle frame 46*c*, it can prevent a position misalignment of the return spring 411.

In the linking block 5, a frame 51 made of metal pivotally supports interlocking bars 52, a latch link 53 and a cradle 54 (note that the operation handle 1 is also pivotally supported by the frame 51). The cradle 54 is coupled with a shaft pressing piece 56 through a link 55. The link 55 is formed so that the intermediate part thereof can be pivoted to bend. Also, the intermediate part of the link 55 is coupled with the operation handle 1 through a handle returning spring 57. The tip of the shaft pressing piece 56 is provided with a pressing part 56*a*. It is configured that the pressing part 56 can contact to and separate from the upper end of the main body 46*a* of the shaft 46. Also, two of the interlocking bars 52 corresponding to the respective poles are provided in the container body A1 so that they stride in the front and the back in FIG. 1. The interlocking bar 52 is configured to be rotated by a kick piece 52*a* thereof being kicked by the tip of an armature piece 63 when the armature piece 63 is attracted by an iron core 62 (described later in detail) in any one of the two electromagnetic tripping blocks 6 which are provided correspondingly to the two poles.

The electromagnetic tripping block 6 includes a coil 61 and the armature piece 63. The coil 61 is inserted in the DC electric path of each pole. An iron core 62 is wound by the coil 61. The armature piece 63 is configured to be attracted by the iron core 62 when an anomalous current of a heavy-current flows through the electric coil 61. One end of the coil 61 is connected to the terminal board 2*b*, and the other end thereof is connected to the terminal board 2*c*. One end of the iron core 62 is bound to one end of a yoke 65. The armature piece 63 is pivotally fitted to the other end of the yoke 65. The armature piece 63 is urged to move away from the other end of the iron core 62 by a returning spring 66. Also, a movable piece (not shown) consisting of an oil-dumped magnetic body is housed in the iron core 62 in a state that the movable piece being urged to move away from the armature piece 63 as well as being movable in the axial direction of the iron core 62. Thus, when an excess current flows in the coil 61 for long time, the magnetic flux passing through the iron core 62 increases by the movement of the movable piece. Thereby, the armature piece 63 is attracted against the elastic force of the returning spring 66. Besides, when short-circuit current flows in the coil 61, the armature piece 63 is attracted without movement of the movable piece.

The behavior of the above-described DC breaker A will now be explained. In the state where the operation handle 1 is in the off-position (when it is tilted over the right end side), the pressing part 56*a* of the shaft pressing piece 56 is separated from the upper end of the main body 46*a* of the shaft 46. In this state, the deterring part 46*b* of the shaft 46 is biased upward by the elastic force of the return spring 411, and the deterring part 46*b* pushes the under surface of the movable armature 44. Therefore, the downward displacement of the movable armature 44 is restricted despite the elastic force of the contact pressure spring 410. Thus, the movable armature 44 is displaced upward together with the shaft 46, and the movable contact 45 is not contacted to the fixed contact 43. Therefore, they are opened. That is, the electric path between the power supply side terminal portion 2 and the load side terminal portion 3 is broken.

While, in the state where the operation handle 1 is in the on-position (when it is tilted over the left end side) as shown in FIG. 1, the latch link 53 engages with the interlocking bar 52 and the cradle 54 engages with the latch link 53. Thereby, it prevents the rotation of the cradle 54. Then, the elastic force of the handle returning spring 57 acts to the link 55 in the direction in which the link 55 stretches. Thereby, the link 55 is kept in the state where it pushes the shaft pressing piece 56 downward. Note that, the DC breaker A is made in the bipolar type. In the DC breaker A, a crossbar 58 is pivotally provided in the container body A1 so that it can rotate with respect to the container body A1, and two of the shaft pressing pieces 56 provided side by side in the axis direction of the crossbar 58 are held by the crossbar 58 (in FIG. 1, only one of the shaft pressing pieces 56 corresponding to one-pole is shown). In the DC breaker A, two of the shaft pressing pieces 56 are pushed downward in this state. Here, pressing springs 59 are provided between the crossbar 58 and the respective shaft pressing pieces 56. Then, each of the shaft pressing piece 56 is biased by the pressing spring 59 in the direction that the pressing part 56*a* provided at the tip thereof presses the upper end of the main body 46*a* of the shaft 46.

When the pressing part 56*a* of the shaft pressing piece 56 pushes the shaft 46 downward, the shaft 46 displaces downward against the elastic force of the return spring 411. Then, the movable armature 44, downward displacement of which being restricted by the deterring part 46*b* of the shaft 46, is displaced downward by the elastic force of the contact pressure spring 410. When the shaft 46 is sufficiently displaced downward, the movable contacts 45 of the movable armature 44 come in contact and make conduction with the fixed contacts 43, respectively. Thereby, the fixed contacts 42 are electrically connected to each other through the movable armature 44. That is, the power supply side terminal portion 2 and the load side terminal portion 3 are made in the conduction state. The contact pressure between the movable contact 45 and the fixed contact 43 is secured by the elastic force of the contact pressure spring 410 until the operation handle 1 is operated to off. The movable armature 44 is biased toward the fixed contact 43 side by the contact pressure spring 410. As a result, the movable contact 45 is contacted to the fixed contact 43 in a predetermined contact pressure. According to this arrangement, it can improve the contact reliability. Also, the DC breaker A can be manually opened and closed by manually switching the operation handle 1 between the on-position and off-position.

While, when the electromagnetic tripping block 6, which is provided at each pole, detects an excess current or a short-circuit current, the tip of the armature piece 63 kicks the kick piece 52*a* of the interlocking bar 52. Thereby, the interlocking bar 52 is rotated, and the engagement with the latch link 53 is unlocked. Then, the cradle 54 becomes to be rotatable freely. As a result, the link 55 is bent by the elastic force of the handle returning spring 57. Thereby, the shaft pressing piece 56 is to be pulled up. Note that, the behavior of such a link mechanism is well-known, and the configuration of link mechanism is not limited to that of FIG. 1. The link mechanism may be configured in another one.

In the state where the shaft pressing piece 56 being moved upward and the pressing part 56*a* being apart from the upper end of the shaft 46, the deterring part 46*b* of the shaft 46 is biased upward by the elastic force of the return spring 411 and thereby the deterring part 46*b* comes in contact with the under surface of the movable armature 44. Thereby, the movable armature 44 is restricted its displacement in the downward direction despite the elastic force of the contact pressure spring 410. Then, the movable armature 44 is displaced upward together with the shaft 46, and the movable contact 45 moves away from the fixed contact 43. Therefore, they are opened. That is, in the tripping state resulting from occurring an excess current or a short-circuit current, the electric path between the power supply side terminal portion 2 and the load side terminal portion 3 is to be broken.

Here, pair of the shaft pressing pieces 56 are coupled to each other through the crossbar 58. Thus, when either one of the shaft pressing pieces 56 moves in the direction that the movable contact 45 is separated from the fixed contact 43, the other one of the shaft pressing piece 56 also moves in the direction of breaking the electric path by the rotation of the crossbar 58. In this time, the operation handle 1 is located in the vicinity of the intermediate position in its moving range. By tilting down the operation handle 1 once in the off-position (right end side) and then tilting down it in the on-position (left end side), the fixed contact 43 and the movable contact 45 can be closed from this state.

Also, the present embodiment realizes the fast-close-fast-open mechanism by the combination of the contact block 4 and the linking block 5.

According to the DC breaker A of the present embodiment, the arc generated at the opening point in which the movable contact 45 moving away from the fixed contact 43 is cooled by the mixed gas including hydrogen enclosed within the sealing container 40 of airtight structure thereby high arc voltage is generated. Therefore, this embodiment can rapidly limit the conduction current and also reliably cut off the current in the DC electric path even when the electric path supplies high DC voltage such as around 150 to 300 V. That is, the present embodiment realizes the DC breaker used in the DC electric path with characteristics of trip-free and high breaking capacity. Also, it enables high closed-circuit capacity and long switching-life. Furthermore, a permanent magnet (not shown) is provided in the vicinity of the contact section (fixed contact 43, movable contact 45). Therefore, the arc generated at the time of cut-off is extended by the magnetic field of the permanent magnet. Thereby, the conduction current is limited as well as the arc voltage is increased.

Also, because the contact section is sealed up in the mixed gas mainly composed of the hydrogen, the contact resistance can be stable regardless of the ambient environment. Therefore, the contact reliability is improved. Also, because the contact section is housed in the sealing container 40 of airtight structure, the arc generated at the time of opening will not be released outside the sealing container 40. Therefore, extra space for the arc can be omitted. Thereby size-reduction as well as weight-reduction can be realized, and safeness thereof can be improved. Also, the actuating sound of the contacts is hard to come to leak outside the sealing container 40, therefore it can realize a small sound characteristics.

That is, the DC breaker A of the present embodiment realizes (1) high breaking capacity to the direct current, (2) compact size, (3) enhanced safety, (4) small sound at the time of acting the contacts, and (5) high contact reliability.

Also, according to the DC breaker A of the present embodiment, when an excess current or a short-circuit current flows through the contact section, it can performs the tripping operation, which is the operation to forcibly make open the contacts, by pulling up the shaft pressing piece 56. Thus, it secures the safeness when an anomalous current occurs.

Besides, it is configured that it can close the contacts to be turned on again by operating the operation handle 1 after the tripping operation. Thus, it can improve the convenience of the user when it is used as protecting means of the DC device in substitution for the fuse which is not reusable.

Also, the DC breaker A of the present embodiment is configured to detect leakage current as an anomalous current. The DC breaker A is configured to detect the leakage current by injecting a low-frequency signal into the DC electric path and detecting the low-frequency signal by a current transformer 71. The current transformer 71 is connected to a board-mounted leakage detection circuit 72. When the leakage detection circuit 72 detects an electric leakage, a solenoid (not shown) is driven to kick the above mentioned kick piece 52*a* provided at the interlocking bar 52. Thus, the electric path between the power supply side terminal portion 2 and the load side terminal portion 3 is to be broken as with the case of the above-mentioned tripping state resulting from occurring the excess current or the short-circuit current. Even more particularly, when the solenoid is driven, a reset button 73 (refer to FIG. 1) bounces out from the container body A10, thereby it informs that the electric path is broken because of the electric leakage. Moreover, the leakage detection circuit 72 is so configured that it can apply pseudo-leakage current in the DC electric path which passes through the current transformer 71. It is configured that it performs an operation test for the leakage current when a test switch 74 (refer to FIG. 1) is pushed.

Also, it may be provided with: an outside tripping feature for opening the contact section in response to a signal from outside of the DC breaker A; an auxiliary switch for outputting a signal about the state of the contacts; or an alarm switch for outputting an alarm signal when occurring the trip. When the DC breaker A of the present embodiment is used in a DC distribution system of a building or an electric vehicle and a controller provided in the system is configured to monitor and control the DC breaker A, the system can perform, such as: tripping operation of the DC breaker A in response to the abnormality of the system; system control based on the monitoring condition of the DC breaker A; and so on.

The present embodiment is configured to perform the detection of electric leakage by the current transformer 71 and the leakage detection circuit 72 both of which are provided within the container body A1. Furthermore, it may be provided with a leakage detecting element outside the container body A1, and configured to perform tripping operation based on the detection signal from this leakage detecting element.

It is explained in the above that the DC breaker A is configured in a bipolar type. However, multiple polar type such as three-polar type can be realized by providing the shaft pressing piece 56, the contact block 4, the electromagnetic tripping block 6 etc. to each poles, providing the plurality of the shaft pressing pieces 56 side by side in the axis direction of the crossbar 58, and configuring the shaft pressing pieces 56 so that they act as similar manner with those described above.

Figure 3:
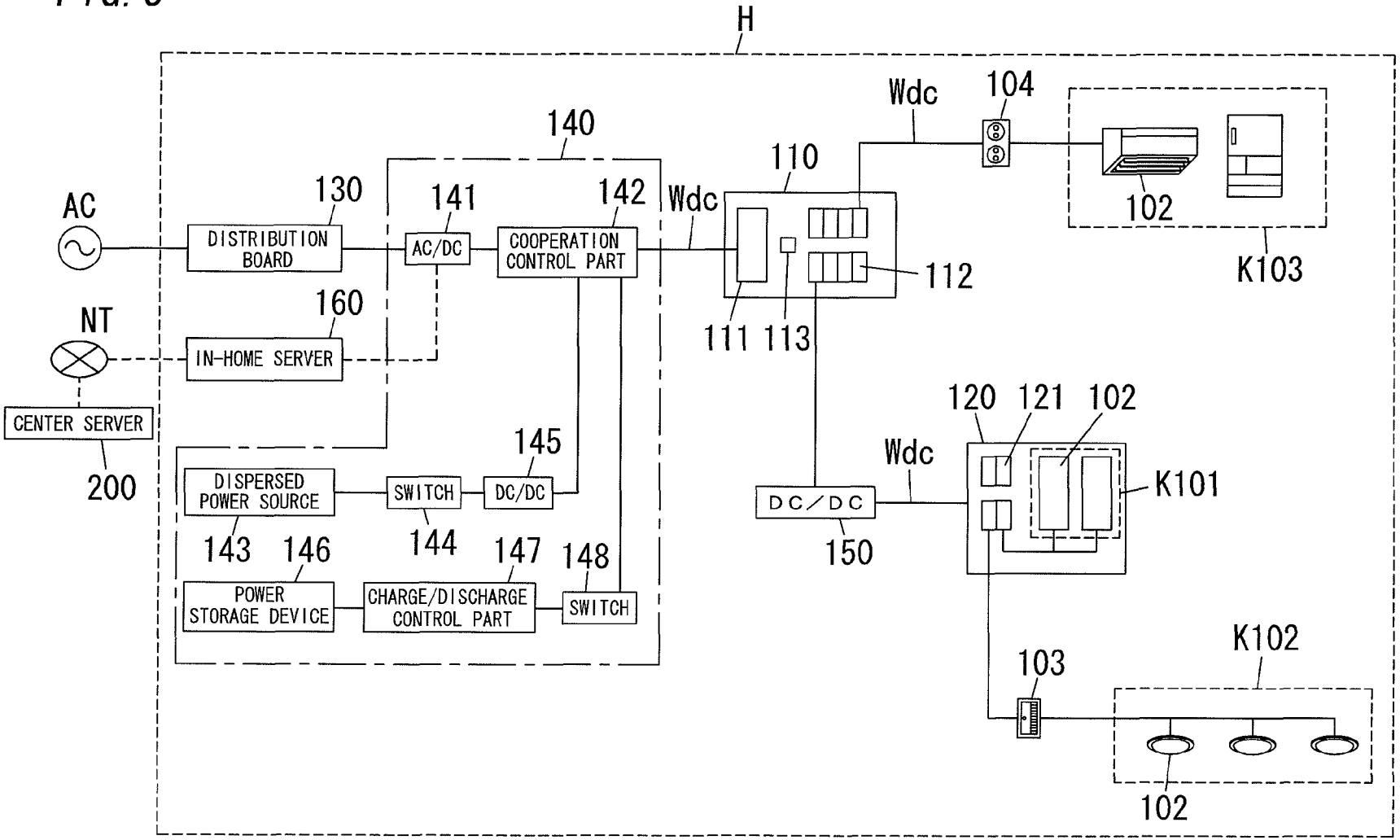

FIG. 3 shows a configuration example of DC distribution system in which the above-described DC breaker A is used. The present DC distribution system is provided in a building H such as house, apartment, and store. The building H is provided with a DC power supply section 140 configured to output DC power and a DC device 102 which is an electric apparatus configured to be driven by DC power. DC power is supplied to the DC device 102 through a DC supply line Wdc connected to the output end of the DC power supply section 140.

Further, a DC distribution board 110 is provided between the DC power supply section 140 and the DC device 102. The DC distribution board 110 holds a DC main breaker 111 and DC branch breakers 112 as internal devices. The DC main breaker 111 and the DC branch breaker 112 are configured to monitor the current flowing in the DC supply line Wdc, and interrupt the electric feeding from the DC power supply section 140 to the DC device 102 on the DC supply line Wdc when detecting an abnormality.

The DC supply line Wdc is configured as a power feeding path of DC power, and also serves as a communication path. Then, the devices connected to the DC supply line Wdc can communicate to each other by superimposing a communication signal, which transmits data through high-frequency carrier wave, upon the DC voltage. This technique is a similar technique with a power line communication technique in which a communication signal is superimposed upon AC voltage in the power line for supplying AC power.

The DC supply line Wdc is connected to an in-home server 160 through the DC power supply section 140. The in-home server 160 is a main device for constructing a communication network in the home (referred to as "home-network"). The in-home server 160 is configured to communicate in the home-network with subsystems constructed by DC devices 102, and monitors/controls the DC devices 102.

The illustrated example includes as the subsystem: an information appliance system K101 composed of information-type DC devices 102 such as a personal computer, a wireless access point, a router, and a IP telephone; a lighting system K102 composed of illumination-type DC devices 102 such as a lighting apparatus; a home electronics system K103 composed of home electronics-type DC devices 102 such as an air-conditioner, a refrigerator; and so on. Also, it can include as the subsystem: an intercom system composed of DC devices 102 for answering the door or monitoring the intruder; a home-alarm system composed of alarm-type DC devices 102 such as a fire detecting system; and so on.

The information appliance system K101 may be composed of: an information device (DC device 102) such as a router, HUB and ONU (Optical Network Unit) attached to a DC information board 120 as an internal device; and an information device (not shown) such as a personal computer connected to the router, HUB, ONU and so on.

The lighting system K102 may be composed of such as: a lighting apparatus (DC device 102) pre-arranged at the building H; and a lighting apparatus (DC device 102) connected to a hook ceiling (ceiling outlet) pre-arranged at the ceiling. Control instruction (for example, instruction for turning on, turning off, dimming/brightening, or blinking) to the lighting apparatus of the DC device 102 consisting the lighting system K102 may be provided by an infrared-rays wireless remote controller, or else, may be provided by a switch 103 connected to the DC supply line Wdc through the communication signal. That is, the switch 103 has a communication function together with the DC device 102.

The home electronics system K103 may be composed of a DC device 102 connected to a pre-arranged (provided when the building H is built) DC outlet formed in shape of such as a wall-outlet or a floor-outlet.

The in-home server 160 not only is connected to the home-network, but also has a connection port for connecting to a wide area network NT constructing the internet. When the in-home server 160 is connected to the wide area network NT, the user can receive the service of, such as, monitoring and controlling the DC device 102 by a center server 200. Here, the center server 200 is a server computer connected to the wide area network NT.

The DC power supply section 140 is configured to, basically, generate DC power by converting the power supplied from the AC power source AC outside the home such as the commercial power source. In the configuration shown in the figure, the AC power of the source AC is input into an AC/DC converter 141 through a main breaker (not shown) which is attached to an AC distribution board 130 as an internal device, and is converted into desired DC voltage. The DC power output from the AC/DC converter 141 is connected to the DC main breaker 111 of the DC distribution board 110 through a cooperation control part 142.

The DC power supply section 140 is provided with dispersed power source 143 such as a solar cell and a fuel cell which generates DC power in preparation for the period when electric power is not supplied from the AC power source AC (e.g., an electric outage period of the commercial power source AC). That is, the main power supply includes the AC/DC converter 141 for generating DC power from the AC power source AC, while the solar cell and the fuel cell are regarded as the dispersed power sources. The DC power output from the dispersed power source 143 is input into a DC/DC converter 145 through a DC switch 144, and is converted into desired DC voltage. The DC power output from the DC/DC converter 145 is connected to the DC main breaker 111 of the DC distribution board 110 through the cooperation control part 142.

Also, the DC power supply section 140 is provided with a power storage device 146 such as a secondary cell, and a charge/discharge control part 147 for controlling the charge/discharge of the power storage device 146. The charge/discharge control part 147 is configured to convert the output voltage of the power storage device 146 into desired DC voltage. The DC power output from the charge/discharge control part 147 is connected to the DC main breaker 111 of the DC distribution board 110 through a DC switch 148 and the cooperation control part 142. Also, the surplus electricity output from the AC/DC converter 141 and the DC/DC converter 145 is transmitted through the cooperation control part 142 and the DC switch 148, and is charged in the power storage device 146 by the charge/discharge control part 147. The power storage device 146 also serves as the dispersed power source as against the main power supply.

In this way, the power storage device 146 is charged at appropriate timing by the main power supply and the dispersed power source. Also, the power storage device 146 is discharged not only at the period when electric power is not supplied from the AC power source AC, but also at appropriate timing if desired. Cooperation between the charge/discharge of the power storage device 146, the main power supply and the dispersed power source is performed by the cooperation control part 142. That is, the cooperation control part 142 functions as a DC power control unit for controlling the power distribution from the DC power supply 140 composed of the AC/DC converter 141, the dispersed power source 143 and the power storage device 146 toward the DC device 102.

The DC power which the cooperation control part 142 outputs is supplied to each DC device 102 through the DC main breaker 111 and the DC branch breaker 112 of the DC distribution board 110. Driving voltage of DC device 102 is selected from several kinds of voltage according to the device. Thus, it is preferable that the cooperation control part 142 is provided with DC/DC converters for converting the DC voltage from the main power supply and the dispersed power source into required voltages. In the present embodiment, the DC voltage which the cooperation control part 142 outputs is either +150V or +300V. Then, either +150V or +300V of DC voltage is supplied to the home electronics system K103 composed of DC device 102 such as an air-conditioner and a refrigerator. The DC device 102 such as the air-conditioner and the refrigerator is configured to be driven by the DC voltage obtained by rectifying the commercial power source of 100V or 200V. The DC voltage of +150V and +300V is approximately equal to the rectified voltage of the commercial power of 100V and 200V. Thus, it is with the suitable voltage for the operation of the DC device 102 such as the air-conditioner and the refrigerator. Note that it may be configured to provide more than 3 wires in one subsystem-system so that it can supply several kinds of voltage. For example, 3 wires may be provided so as to supply the voltages of +150V, −150V and +300V. In this case, the DC breaker A may be configured in three-polar type.

Also, a DC/DC converter 150 is configured to depress the DC voltage which the cooperation control part 142 outputs. The DC power of the depressed voltage is supplied to the information appliance system K101 and the lighting system K102 through a DC low-voltage circuit protector 121. The DC low-voltage circuit protector 121 is attached to the DC information board 120 as an internal device. In view of the safeness, the DC/DC converter 150 is composed of a switching power supply using an isolation transformer.

Furthermore, in the DC distribution board 110, a leakage detecting element 113 is attached at the secondary side of the DC main breaker 111. The DC main breaker 111 is configured to perform a trip to break the electric path based on a leakage detection signal from the leakage detecting element 113.

In such a DC distribution system, reliability and safeness of the system can be improved by adopting the DC breaker A of the present invention as: the switch 144 interposed in the DC electric path of the dispersed power source 143; the switch 148 interposed in the DC electric path of the power storage device 146; the DC main breaker 111 and the DC branch breaker 112 in the DC distribution board 110; and the DC low-voltage circuit protector 121 in the DC information board 120.

Also, as for an electric vehicle, similar effect with described above can be obtained by adopting the DC breaker A of the present invention in the DC power supply path from a driving cell of the electric vehicle.

Although the present invention has been described with reference to certain preferred embodiments, numerous modifications and variations can be made by those skilled in the art without departing from the true spirit and scope of this invention, namely claims.

The invention claimed is:

1. A DC breaker comprising:

a fixed terminal provided with a fixed contact;

a movable armature provided with a movable contact which contacts to or separates from said fixed contact, said movable armature being provided with a shaft insertion hole passing therethrough in the approaching/separating direction of said movable contact with respect to said fixed contact;

a shaft having a main body and a deterring part, said main body being inserted in said shaft insertion hole of said movable armature, said deterring part being formed in un-insertable shape in said shaft insertion hole and being coupled with one end of said main body to restrict the movement of said movable armature into the direction in which said movable contact approaches to said fixed contact;

a sealing container housing said movable armature and said shaft therein in hermetically-sealed state and also holding said fixed terminal so that said fixed contact being exposed thereinside;

a contact pressure spring consisting of a coil spring arranged within said sealing container, said main body of said shaft being inserted in said contact pressure spring, said contact pressure spring being configured to resiliently contact at one end thereof to said movable armature to urge said movable armature to approach toward said fixed contact and to give contact pressure between said movable contact and said fixed contact;

a return spring consisting of a coil spring arranged within said sealing container, said return spring being configured to resiliently contact at one end thereof to said deterring part of said shaft to urge said shaft to move away from said fixed contact;

an operation handle;

a pressing means configured to press, in accordance with the operation of said operation handle, the other end of said main body of said shaft to move said deterring part of said shaft closer to said fixed contact; and a tripping means configured to make said movable contact and said fixed contact open by taking said pressing means away from said the other end of said main body of said shaft in case that an anomalous current flows through said movable contact and said fixed contact when they are contacted.

2. The DC breaker as set forth in claim 1, wherein mixed gas including hydrogen is enclosed in said sealing container.

3. The DC breaker as set forth in claim 1, wherein said DC breaker further comprises a leakage detection means configured to detect electrical leakage of DC electric path in which a contact section consisting of said movable contact and said fixed contact being inserted, and said tripping means is configured to make said movable contact and said fixed contact open by taking said pressing means away from said the other end of said main body of said shaft when the electrical leakage is detected.

4. The DC breaker as set forth in claim 2, wherein said DC breaker further comprises a leakage detection means configured to detect electrical leakage of DC electric path in which a contact section consisting of said movable contact and said fixed contact being inserted, and said tripping means is configured to make said movable contact and said fixed contact open by taking said pressing means away from said the other end of said main body of said shaft when the electrical leakage is detected.

* * * * *